US006639341B1

(12) United States Patent
Sakai et al.

(10) Patent No.: US 6,639,341 B1
(45) Date of Patent: Oct. 28, 2003

(54) METAL HALIDE DISCHARGE LAMP

(75) Inventors: Kazuhiko Sakai, Osaka (JP); Atsunori Okada, Toyonaka (JP); Singo Higashisaka, Kadoma (JP); Takuma Hashimoto, Yawata (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/535,746

(22) Filed: Mar. 27, 2000

(30) Foreign Application Priority Data

Mar. 26, 1999 (JP) ..... 11-082730
Feb. 24, 2000 (JP) ..... 2000-047015

(51) Int. Cl.[7] ..... H05B 31/04; H01J 17/16; H01J 17/20

(52) U.S. Cl. ..... 313/25; 313/635; 313/638

(58) Field of Search ..... 313/637, 638, 313/639, 642, 634, 635, 113, 25

(56) References Cited

U.S. PATENT DOCUMENTS 3,662,203 A * 5/1972 Kuhl et al. ..... 313/25
3,979,624 A * 9/1976 Liu et al. ..... 313/25
4,029,983 A * 6/1977 Thornton ..... 313/25
4,467,238 A * 8/1984 Silverstein et al. ..... 313/25
4,634,927 A * 1/1987 Mori et al. ..... 313/637
4,701,664 A * 10/1987 Larue et al. ..... 313/112
4,709,184 A * 11/1987 Keeffe et al. ..... 313/638
4,890,030 A * 12/1989 Keeffe et al. ..... 313/25
5,159,229 A * 10/1992 Passmore et al. ..... 313/25
5,225,738 A * 7/1993 Ramaiah et al. ..... 313/641
5,363,007 A * 11/1994 Fromm et al. ..... 313/639
5,550,421 A * 8/1996 Scholz et al. ..... 313/25
5,610,469 A * 3/1997 Bergman et al. ..... 313/25
6,353,289 B1 * 3/2002 Ishigami et al. ..... 313/643

FOREIGN PATENT DOCUMENTS

JP 55032355 3/1980 ..... H01J/61/20
JP 56109447 8/1981 ..... H01J/61/20
JP 06084496 3/1994 ..... H01J/61/18
JP 06111772 4/1994 ..... H01J/61/20
JP 08203471 8/1996 ..... H01J/61/30

* cited by examiner

*Primary Examiner*—Nimeshkumar D. Patel
*Assistant Examiner*—Karabi Guharay
(74) *Attorney, Agent, or Firm*—Rader, Fishman & Grauer PLLC

(57) ABSTRACT

A metal halide discharge lamp which is capable of reducing a color change when subjected to a variation in the lamp power and/or the voltage supplied to the lamp. The metal halide lamp has an arc tube filled with at least sodium halide and scandium halide. The arc tube is formed at its opposite ends with electrodes which gives an arc discharge therebetween. The lamp has regulator means for keeping a coldest spot temperature of the arc tube at 550° C. or more when operating the lamp at a lamp power which is 50% or rated lamp power. It is found that when the lamp is configured to have a coldest spot temperature at 550° C. or more when operating the lamp at a lamp power which is 50% of the rated lamp power, the lamp shows much less color variation even subjected to the lamp voltage variation, thereby maintaining a desired color.

21 Claims, 7 Drawing Sheets

Examples 4 & 7

Example 11

Example 6

Example 3

METAL HALIDE DISCHARGE LAMP

BACKGROUND OF THE INVENTION

1. Field of the Invention

The present invention is directed to a metal halide discharge lamp, and more particularly a discharge lamp having an arc tube filled with metal halides.

2. Description of the Prior Art

Metal halide discharge lamps have been used in a wide variety of fields because of its superior performances, such as high luminance, high efficiency, and high color rendering properly. Among these, a metal halide lamp having an arc tube filled with sodium halide and scandium halide is preferred as it shows a less color change. That is, even when luminous intensity of reddish color from vapors of sodium halide varies to some extent, vapor of the scandium halide can provide a continuous color spectrum, thereby giving less change in color. Such discharge lamp is disclosed in the following listed prior art.

List of the Prior Art a) Japanese Patent Early Publication No. 6-84496 b) Japanese Patent Early Publication No. 6-111772 c) Japanese Patent Early Publication No. 8-203471 d) Japanese Patent Early Publication No. 55-32355 e) Japanese Patent Early Publication No. 56-109447

Concise Explanation of the Listed Prior Art

Publication No. 6-84496 and No. 6-111772 disclose a metal halide lamp having an arc tube filled with sodium iodide, scandium iodide, and an inert gas but without mercury. It is described in this publication that due to the absence of mercury, color spectrum is substantially the same irrespective of a variation of an input power, causing no substantial change in color.

Publication No. 8-203471 discloses a metal halide lamp having an arc tube filled with sodium iodide scandium iodide, and a xenon gas. The arc tube is sealed within an envelope which is evacuated or filled with a lower pressure gas for thermally insulating the arc tube from outside of the envelope for limiting a cooling effect of the arc tube.

Publication No. 55-32355 discloses a metal halide lamp having an arc tube filled with sodium iodide, scandium iodide, mercury, and an inert gas. Scandium iodide is filled in a specific range of amount in relation to a rated lamp power, while a ratio of the filling amount of sodium iodide to that of scandium iodide is selected to a specific value, in order to improve lamp efficiency and operational life period.

Publication No. 56-109447 discloses a metal halide lamp having an arc tube filled with sodium iodide, scandium iodide, mercury, and an inert gas. The lamp is designed to satisfy a specific range as to a molar ratio of sodium iodide to scandium iodide, and at the same time to satisfy a specific relation between the molar ratio and cold spot temperature during a normal lamp operation at a rated power.

Problem of the Prior Art

However, the prior art discharge lamp is found still insufficient in keeping a uniform color when subjected to variations in a lamp power as well as in a voltage supplied to the lamp. Thus, dimming control of varying the lamp power may result in undesired color change of the lamp, and Thus, undesired color change may occur when dimming the lamp by varying the lamp power or when there is a variation in an output voltage from a ballast as a result of a variation in the line voltage, or in quality of the ballast, or even in quality of the lamp.

SUMMARY OF THE INVENTION

In view of the above, the present invention has been achieved to provide a metal halide discharge lamp which is capable of reducing a color change when subjected to a variation in the lamp power and/or the voltage supplied to the lamp. The metal halide lamp in accordance with a present invention comprises an arc tube filled with at least sodium halide and scandium halide. The arc tube is formed at its opposite ends with electrodes which gives an arc discharge therebetween. The lamp has regulator means for keeping a coldest spot temperature of the arc tube at 550° C. or more when operating the lamp at a lamp power which is 50% of rated lamp power. It is found that when the lamp is configured to have a coldest spot temperature at 550° C. or more when operating the lamp at a lamp power which is 50% of the rated lamp power, the lamp shows much less color change even subjected to the lamp voltage variation, thereby maintaining a desired color. The arc tube may be made of quartz or a transparent ceramic.

The lamp includes an envelope which forms a hermetically sealed space for accommodating therein the arc tube. The envelope is evacuated or filled with low pressure inert gas to define the regulator means. The envelope may be coated on its inner surface with a layer of reflecting an infrared radiation or with a phosphor.

Preferably, scandium halide is filled the arc tube in an amount of less than 4.08 mol/ml$\times 10^{-6}$ mol/ml to stabilize the arc discharge.

In a preferred embodiment, the lamp include a sleeve surrounding the arc tube to reduce a heat loss form the arc tube. Thus, the sleeve defines the regulator means alone or in combination with the envelope. The sleeve may be coated on its inner surface with a layer of reflecting an infrared radiation. The layer may be coated on the entire surface or partially on opposite ends of the sleeve corresponding to the electrodes.

Further, the lamp includes heat insulators formed on the arc tube at portions covering the respective electrodes so as to thermally insulate the portions of the arc tube adjacent the electrodes from the outside thereof. Thus, the heat insulators can define the regulator means alone or in combination with the envelope or the sleeve. The heat insulator may be a metal layer of reflecting the infrared radiation.

The arc tube may be formed to have reduced-in-diameter sections at opposite ends of the tube which have a diameter less than the rest and surround the electrodes, respectively. With the provision of the reduced-in-diameter sections, the opposite ends of the arc tube is kept at a relatively high temperature due to the heat from the adjacent electrodes. Thus, the sections can define the regulator means alone or in combination with the envelope, sleeves, or the heat insulators.

Formed at opposite ends of the arc tube are sealed ends for sealing the electrodes. The sealed ends are preferably made to have an outside diameter less than that of the arc tube for retarding the cooling of the arc tube around the electrodes. Thus, the sealed ends can also define the regulator means.

A molar ratio (R) of sodium halide to scandium halide is preferably between 2.8 to 22.7 in order to reduce color change when the lamp subjected to the variation in the voltage supplied to the lamp. For the lamp having a rated lamp power of less than 400 W, the molar ratio is preferably between 2.8 to 17.0. For the lamp having a rated power of 400W or more, the molar ratio is preferably between 5.7 to 22.7. The arc tube may additionally include cesium iodide or mercury.

For one lamp configuration where the envelope is evacuated, and the arc tube is made of quartz into a cylindrical shape and is formed on opposite ends with the heat insulators covering the electrodes, the arc tube is preferably designed to have an inside diameter of about 8 mm and a distance of about 80 mm between the electrodes, and is filled with about $2.32\times10^{-5}$ mol/ml of sodium iodide, about $2.04\times10^{-6}$ mol/ml of scandium iodide, about $1.2\times10^{-5}$ mol/ml of cesium iodide, and about 27000 Pa of xenon.

For another lamp configuration where the envelope is evacuated with its inner surface coated with a phosphor layer, and the arc tube is made of quartz into a cylindrical shape and is formed on opposite ends with the heat insulators covering the electrodes, the arc tube is preferably designed to have an inside diameter of about 8 mm and a distance of about 80 mm between the electrodes, and is filled with about $2.32\times10^{-5}$ mol/ml of sodium iodide, about $2.04\times10^{-6}$ mol/ml of scandium iodide, about $2.5\times10^{-5}$ mol/ml of mercury and about 6700 Pa of argon.

For a further lamp configuration where the arc tube is made of quartz into a ellipsoidal shape and is formed on opposite ends with the heat insulators covering the electrodes and with sealing ends for sealing the electrodes, and the correspondingly shaped envelope is evacuated, the ellipsoidal arc tube is preferably designed to have a maximum inside diameter of about 18 mm, an average inside diameter of about 14 mm, and a distance of about 48 mm between the electrodes, and is filled with about $1.35\times10^{-5}$ mol/ml of sodium iodide, about $1.15\times10^{-8}$ mol/ml of scandium iodide, about $2.14\times10^{-5}$ mol/ml of mercury and about 6700 Pa of argon. In this configuration, the sealed ends are also designed to be smaller in diameter than the arc tube.

For a still further lamp configuration where the arc tube is made of quartz into a ellipsoidal shape and is formed on opposite ends with the heat insulators covering the electrodes and with sealing ends for sealing the electrodes, and the correspondingly shaped envelope is evacuated, the ellipsoidal arc tube is preferably designed to have a maximum inside diameter of about 18 mm, an average inside diameter of about 14 mm, and a distance of about 48 mm between the electrodes, and is filled with about $1.35\times10^{-5}$ mol/ml of sodium iodide, about $1.15\times10^{-6}$ mol/ml of scandium iodide, and about 6700 Pa of argon, said envelope being filled with about 47000 Pa of nitrogen gas. Also in this configuration, the sealed ends are also designed to be smaller in diameter than the arc tube.

These lamp configurations are particularly advantageous for realizing the regulator means for maintaining the coldest spot temperature of the arc tube at 550° C. or more when operating the lamp at a lamp power which is 50% of rated lamp power, thereby reducing the color change even subjected to the variation in the voltage supplied to the lamp.

These and still other objects and advantageous features of the present invention will become more apparent from the following description of the embodiments when taken in conjunction with the attached drawings.

BRIEF DESCRIPTION OF THE EMBODIMENTS

DETAILED DESCRIPTION OF THE EMBODIMENTS

Figure 1:
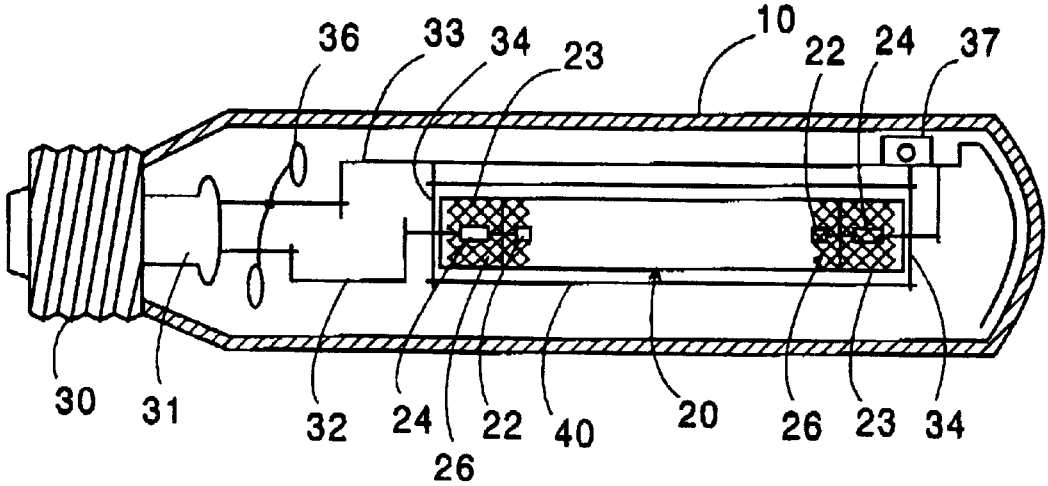
FIG. 1 is a cross section of a metal halide discharge lamp in accordance with a first embodiment of the present invention.
Figure 14:
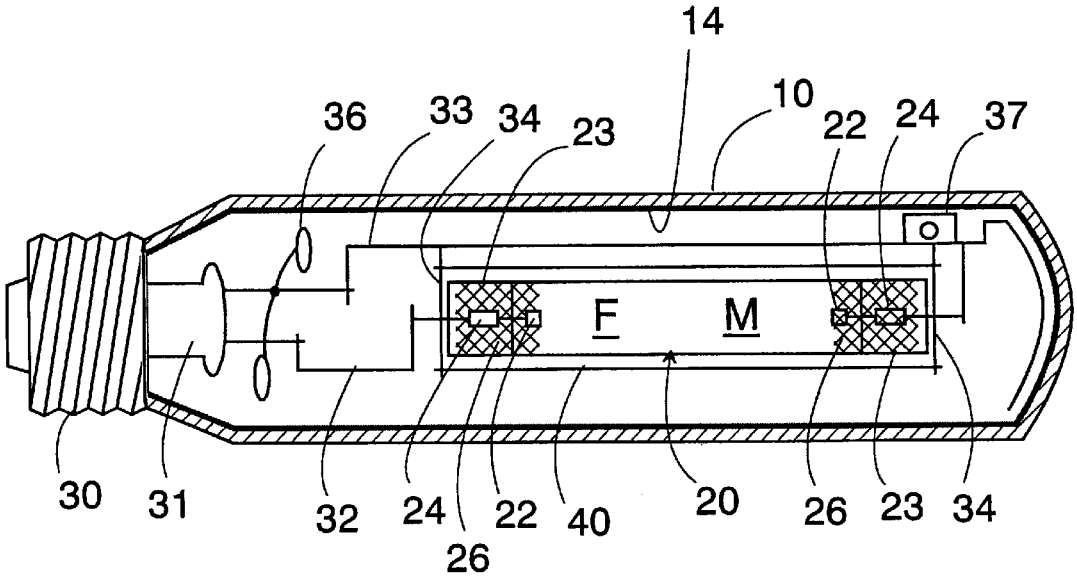
FIG. 14 is a cross section of the metal halide discharge lamp similar to the one shown in FIG. 1 with an infrared radiation reflecting layer.

Referring now to FIG. 1, there is shown a metal halide discharge lamp in accordance with a first embodiment of the present invention. The lamp comprises a glass-made envelope 10 forming a hermetically sealed space therein, an arc tube 20 disposed in the space, and a base 30 attached to one end of the envelope 10. The arc tube 20 is in the form of a cylinder having a uniform diameter and is supported to the envelope 10 through a pair of conductor props 32 and 33 extending commonly from a stem 31 fixed to the base 30. The arc tube 20 is also of a cylindrical shape with a uniform diameter and has electrodes 22 at opposite lengthwise ends thereof. The arc tube is made of quartz or transparent ceramic to have at the opposite end sealed rends 23 for sealing the electrodes 22. The electrodes 22 are connected respectively through molybdenum foils 24 to the conductor props 32 so as to develop an arc discharge between the electrodes 22. As shown in FIG. 14, a filler F fills the arc tube 20 and such fillers are sodium iodide, scandium iodide, and inert gas, for example. Additional metal halide or mercury M may be added in the tube.

Heat insulator layers 26 made of metal or zirconium oxide are formed respectively on the outer surfaces of the opposite ends of the arc tube to surround the electrodes 22 as well as the sealed ends 23 for reducing heat dissipation from around the electrodes 22. A transparent sleeve 40 also of a cylindrical shape is disposed in the envelope 10 to surround the arc tube in an intimate relation thereto for reducing heat dissipation from the arc tube. The arc tube 20 is supported to the one conductor prop 33 by means of arms 34. The conductor prop 34 carries at its one end adjacent the stem 31 a barium getter 36 and at the opposite end a zirconium-aluminum getter 37.

The lamp is driven by a conventional magnetic ballast which includes a starter to apply a pulsating voltage to start the lamp and includes a dimmer function of varying a lamp power for dimming control of the lamp.

Figure 2:
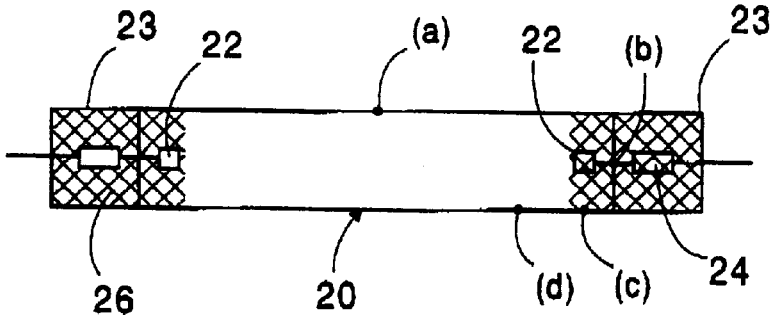
FIG. 2 is a front view of an arc tube utilized in the above lamp, showing cold spots of the tube.

In the above lamp, the envelope 10, the heat insulator layer 26, and the sleeve 40 are either alone or in combination to define a regulator means which is responsible for keeping a coldest spot temperature of 550° C. or more when the lamp is operated at a lamp power which is 50% of a rated lamp power. The coldest spot temperature is determined to the temperature of the coldest one of spots that are chosen as indicated by (a), (b), (c), and (d) in FIG. 2, where spot (a) is a tip-off, spot (b) is a root of the electrode, (c) is a bottom of the heat insulator at a horizontal lamp operation, and (d) is a point from which a bent arc is kept away or where unvaporized metal halides remain.

Figure 3:
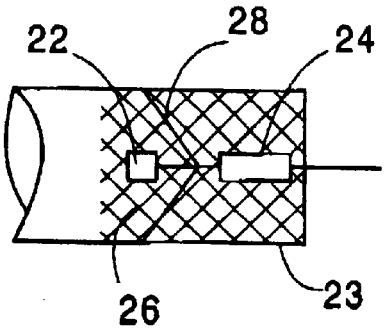
FIGS. 3 and 4 are partial front views, respectively of modified end configurations of the arc tube.
Figure 4:
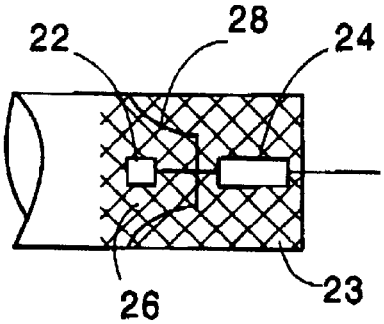

As shown in FIGS. 3 and 4, the arc tube 20 may be configured to have its opposite ends shaped into reduced-in-diameter sections 28 around the electrodes 22 in order to narrower a spacing between the electrodes and the adjacent tube walls. The reduced-in-diameter section 28 is in the form of a tapered section which reduces the area of surface surrounding the adjacent electrode than the non-tapered end of the arc tube, thereby reducing a heat loss from the surface surrounding the electrode. Also, because of that the reduced-in-diameter sections are made close to the electrodes, the arc tube can have an increased wall temperature. In this sense, the reduced-in-diameter sections 28 is alone or in combination with at least one of the envelope, sleeve, and the heat insulator layer to define the above regulator means.

Figure 5:
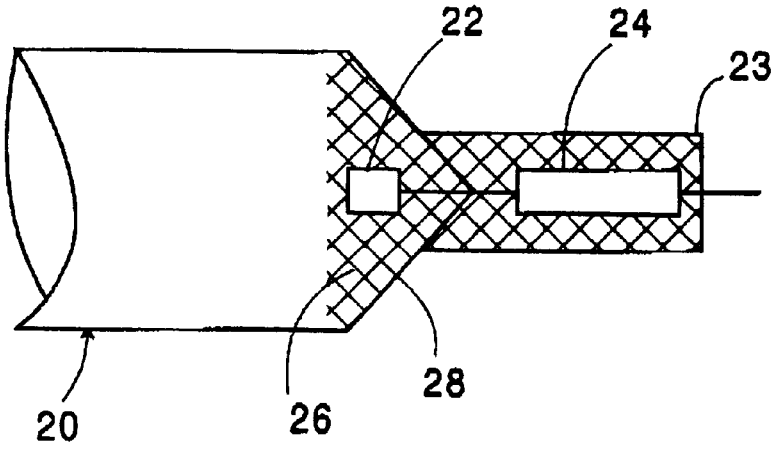
FIG. 5 is a partial front view showing a sealed end of a modified arc tube.
Figure 6:
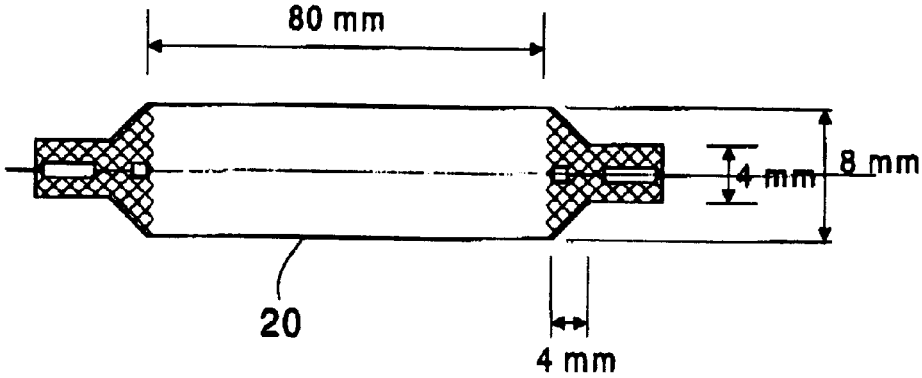
FIG. 6 is a front view of the arc tube of FIG. 5.
Figure 7:
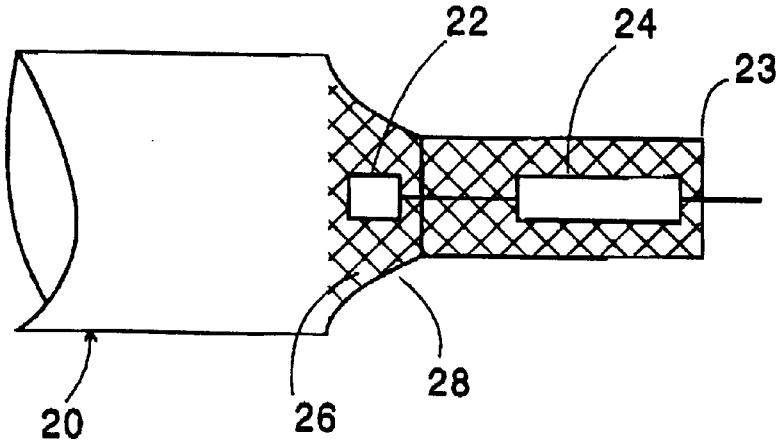
FIG. 7 is a partial front view showing a sealed end of a modified arc tube.

Further, as shown in FIGS. 5 and 7, the sealed ends 23 may be shaped to have an outside diameter smaller than the arc tube 20 so as to reduce a heat loss by radiation and/or conduction from the sealed ends, thereby keeping the outer surface of the sealed end 23 at a relatively high temperature and therefore the adjacent ends of the arc tube around the electrodes. In this sense, the small-sized sealing ends 23 can additionally constitute the above regulator means either alone or in combination with at least one of the envelope, sleeve, heat insulator layer, and the reduced-in-diameter section for keeping the coldest spot temperature at a relatively high level when the lamp is operated at a reduced lamp power. The arc tube having the small-sized sealed ends 23 of FIG. 5 is preferred to have dimensions as shown in FIG. 6.

Figure 8:
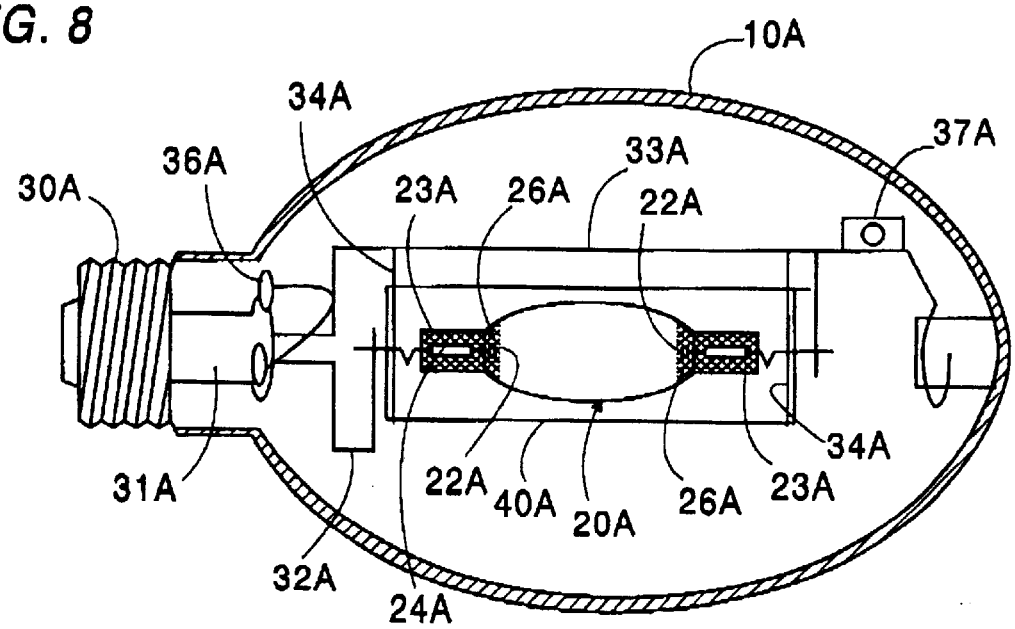
FIG. 8 is a cross section of a metal halide discharge lamp in accordance with a second embodiment of the present invention.
Figure 9:
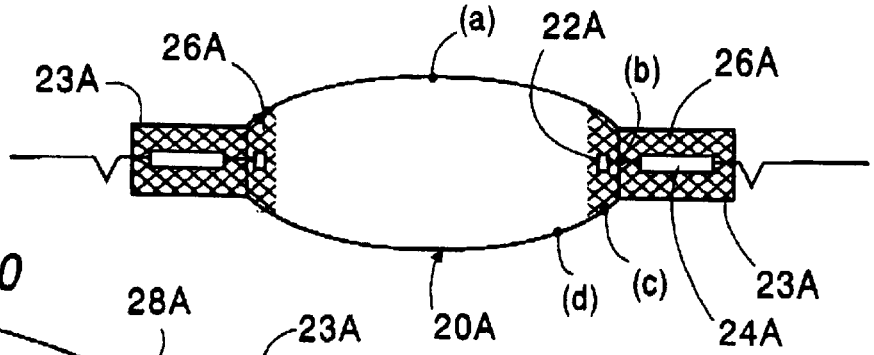
FIG. 9 is a front view of an arc tube utilized in the above lamp, showing cold spots of the tube.

FIG. 8 shows a lamp in accordance with a second embodiment which is similar to the first embodiment except that an arc tube 20A and an envelope 10A are both ellipsoidal in shape. Like parts are designated by like reference numerals with a suffix letter of 'A'. Also in this lamp, the envelope 10A is cooperative with at least one of the heat insulator layer 26A and the sleeve 40A to define a regulator means which is responsible for keeping a coldest spot temperature of 550° C. or more when the lamp is operated at a lamp power which is 50% of a rated lamp power. The coldest spot temperature is determine to the temperature of the coldest one of spots that are chosen as indicated by (a), (b), (c), and (d) in FIG. 9.

Figure 10:
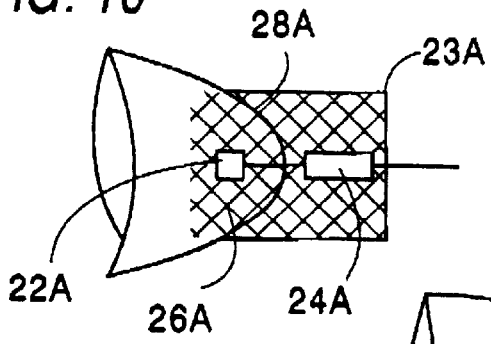
FIG. 10 is a partial front view showing a modified end configuration of the arc tube.

As shown in FIG. 10, the arc tube 20A may be configured to have its opposite ends shaped into reduced-in-diameter sections 28A around the electrodes 22A in order to narrower a spacing between the electrodes and the adjacent tube walls, thereby reducing cooling effect of the tube walls. In this sense, the reduced-in-diameter sections 28A can constitute the above regulator means.

Figure 11:
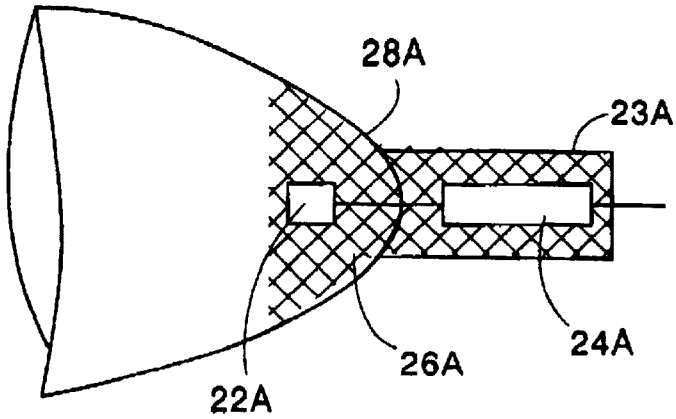
FIG. 11 is a partial front view showing a sealed end of a modified arc tube.

Further, as shown in FIG. 11, the sealed ends 23A may be shaped to have an outside diameter smaller than the arc tube 20A so as to keep the outer surface of the sealed end 23A at a relatively high temperature and therefore the adjacent ends of the arc tube around the electrodes. In this sense, the small-sized sealing ends 23A can constitute the above regulator means for keeping the coldest spot temperature at a relatively high level when the lamp is operated at a reduced lamp power.

The following examples further illustrate the nature and advantages of the present invention.

EXAMPLES 1 to 9

Lamps were fabricated in accordance with the first embodiment to have arc tubes of quartz which were dimensioned to have an inside diameter of 8 mm, and a distance of 80 mm between the electrodes. The arc tubes were filled mainly with sodium iodide and scandium iodide, with or without cesium iodide or mercury in listed amounts as shown in Table 1 below. The lamps were configured to have the regulator means defined by the envelope in combination with at least one of the sleeve, heat insulator layers, reduction-in-diameter sections, and the sealed ends, as shown in Table 1. For a comparative purposes, Comparative Example 1 were prepared which is identical to Example 1 except that the regulator means was not included.

EXAMPLE 10 and 11

Lamps were fabricated in accordance with the second embodiment to have arc tubes which were made of quartz and dimensioned to have a maximum inside diameter of 18 mm, and a distance of 48 mm between the electrodes. The arc tubes were filled mainly with sodium iodide and scandium iodide, and with cesium iodide or mercury in listed amounts as shown in Table 1 below. The lamps were configured to have the regulator means defined by the envelope in combination with at least one of the envelope, sleeve, heat insulator layers, reduction-in-diameter sections, and the sealed ends, as shown in Table 1. For a comparative purposes, Comparative Example 2 was prepared which is identical to Example 10 except that the regulator means was not included.

In order to evaluate the lamp characteristics for the Examples 1 to 11 and Comparative Examples 1 and 2, measurements were made to obtain a coldest spot temperature (CST) (°C.) at operating at 100% of rated lamp power and reduced lamp power as listed, as well as to obtain a variation ($\Delta T$ (K)) in color temperature when the voltage supplied to the lamp, i.e., the input source voltage to the magnetic ballast varies.

TABLE 1

| Lamp | Arc tube material | NaI ($\times 10^{-5}$ mol/ml) | $ScI_3$ ($\times 10^{-6}$ mol/ml) | NaI/$ScI_3$ (molar ratio) | CsI filled | Hg filled | Envelope | Envelope evacuated | Envelope with phosphor coating | Envelope with IR reflection coating |
|---|---|---|---|---|---|---|---|---|---|---|
| Example 1 | Quartz | 2.32 | 2.04 | 11.4 | No | No | Yes | No | No | No |
| Example 2 | Quartz | 2.32 | 4.08 | 5.7 | Yes | No | Yes | No | No | No |
| Example 3 | Quartz | 0.58 | 1.02 | 5.7 | Yes | No | Yes | Yes | No | No |
| Example 4 | Quartz | 1.16 | 2.04 | 5.7 | Yes | No | Yes | Yes | No | Yes |
| Example 5 | Quartz | 2.32 | 2.04 | 11.4 | Yes | No | Yes | Yes | No | No |
| Example 6 | Quartz | 2.32 | 2.04 | 11.4 | No | Yes | Yes | Yes | Yes | No |
| Example 7 | Quartz | 3.48 | 2.04 | 17.1 | Yes | No | Yes | Yes | No | Yes |
| Example 8 | Quartz | 3.48 | 2.04 | 17.1 | Yes | No | Yes | Yes | No | No |
| Example 9 | Ceramic | 2.32 | 2.04 | 11.4 | Yes | No | Yes | Yes | No | No |
| Comparative Example 1 | Quartz | 2.32 | 2.04 | 11.4 | No | No | No | — | No | — |
| Example 10 | Quartz | 1.31 | 1.15 | 11.4 | No | Yes | Yes | Yes | No | No |
| Example 11 | Quartz | 1.97 | 1.15 | 17.0 | Yes | Yes | Yes | Nitrogen filled | Yes | Yes |
| Comparative Example 2 | Quartz | 1.31 | 1.15 | 11.4 | No | Yes | No | — | No | — |

| Lamp | Sleeve | Sleeve with IR reflection coating | Sleeve With IR reflection coating only on opposite ends | Heat insulator layer | Metal heat insulator layer | Reduced-in-diameter section | Sealed ends size | Arc bent | Wla (%) | CST (° C.) | ΔT (K) on input source voltage variation | Rated power (Watts) |
|---|---|---|---|---|---|---|---|---|---|---|---|---|
| Example 1 | No | — | — | No | — | No | Normal | None | 100<br>50 | 631<br>551 | 63 | 250 |
| Example 2 | No | — | — | Yes | No | No | Normal | Yes | 100<br>50 | 628<br>589 | 42 | 250 |
| Example 3 | Yes | | Yes | Yes | No | No | Normal | None | 100<br>50 | 590<br>555 | 120 | 250 |
| Example 4 | No | — | — | Yes | No | No | Normal | None | 100<br>50 | 601<br>566 | 65 | 250 |
| Example 5 | No | — | | Yes | Yes | No | Normal | None | 100<br>50 | 624<br>552 | 73 | 250 |
| Example 6 | Yes | Yes | — | Yes | Yes | No | Normal | None | 100<br>50 | 663<br>622 | 55 | 250 |
| Example 7 | Yes | No | — | Yes | No | No | Normal | None | 100<br>50 | 719<br>615 | 24 | 250 |
| Example 8 | No | — | — | Yes | Yes | Yes | Small | None | 100<br>50 | 690<br>575 | 44 | 250 |
| Example 9 | No | — | — | No | No | Yes | Normal | None | 100<br>50 | 650<br>579 | 34 | 250 |
| Comparative Example 1 | No | — | — | No | — | No | Normal | None | 100<br>63 | 503<br>459 | 442 | 250 |
| Example 10 | No | — | — | Yes | Yes | Yes | Small | None | 100<br>50 | 752<br>645 | 85 | 400 |
| Example 11 | Yes | Yes | — | Yes | No | Yes | Small | None | 100<br>50 | 697<br>612 | 64 | 400 |
| Comparative Example 2 | No | — | — | No | — | No | Normal | None | 100<br>50 | 648<br>500 | 658 | 400 |

In Examples 2 to 5, 7 to 9, and 11, cesium iodide was added in an amount of $1.25\times10^{-5}$ mol/ml. In Examples 6, 10, and 11, mercury was added in an amount of $2.50\times10^{-5}$ mol/ml. In Examples 11, mercury was added in an amount of $1.53\times10^{-5}$ mol/ml.

As to the column 'envelope' in Table 1, 'Yes' denotes the use of the envelope. As to the column 'envelope evacuated', 'Yes' denotes that the envelope is evacuated. Further, Examples 6 and 11 utilize the envelopes each coated on its inner surface with a phosphor coating, while Examples 4, 7, and 11 utilized the envelopes each coated on its inner surface with a coating capable of reflecting infrared radiation. Examples 2 to 4, 7, and 11 utilized the heat insulator layer made of zirconium oxide, while Examples 5, 6, 8, and 10 utilized the heat insulator layer of metal such as platinum or gold capable of reflecting infrared radiation to a large extent than zirconium oxide. In Examples 8 to 11, the reduced-in-diameter sections were formed on opposite ends of the arc tube. In Examples 10 and 11, the sealed ends of the arc tube were made to have a smaller diameter than the arc tube as shown in FIG. 6. Arc bent was seen in Example 2.

As is seen from Table 1, Comparative Examples 1 and 2 show decreased coldest spot temperatures of 459° C. and 500° C., respectively when the lamp power (Wla) is reduced to 63% of the rated power, and large color temperature variation widths (ΔT) of 442K and 658K when the input source voltage varies by ±10%. On the other hand, all the Examples show the color temperature variation width (ΔT) of 120K or less in response to ±10% variation of the input source voltage to the ballast. This means that Examples are capable of reducing color change even subjected to source voltage variations.

Figure 12:
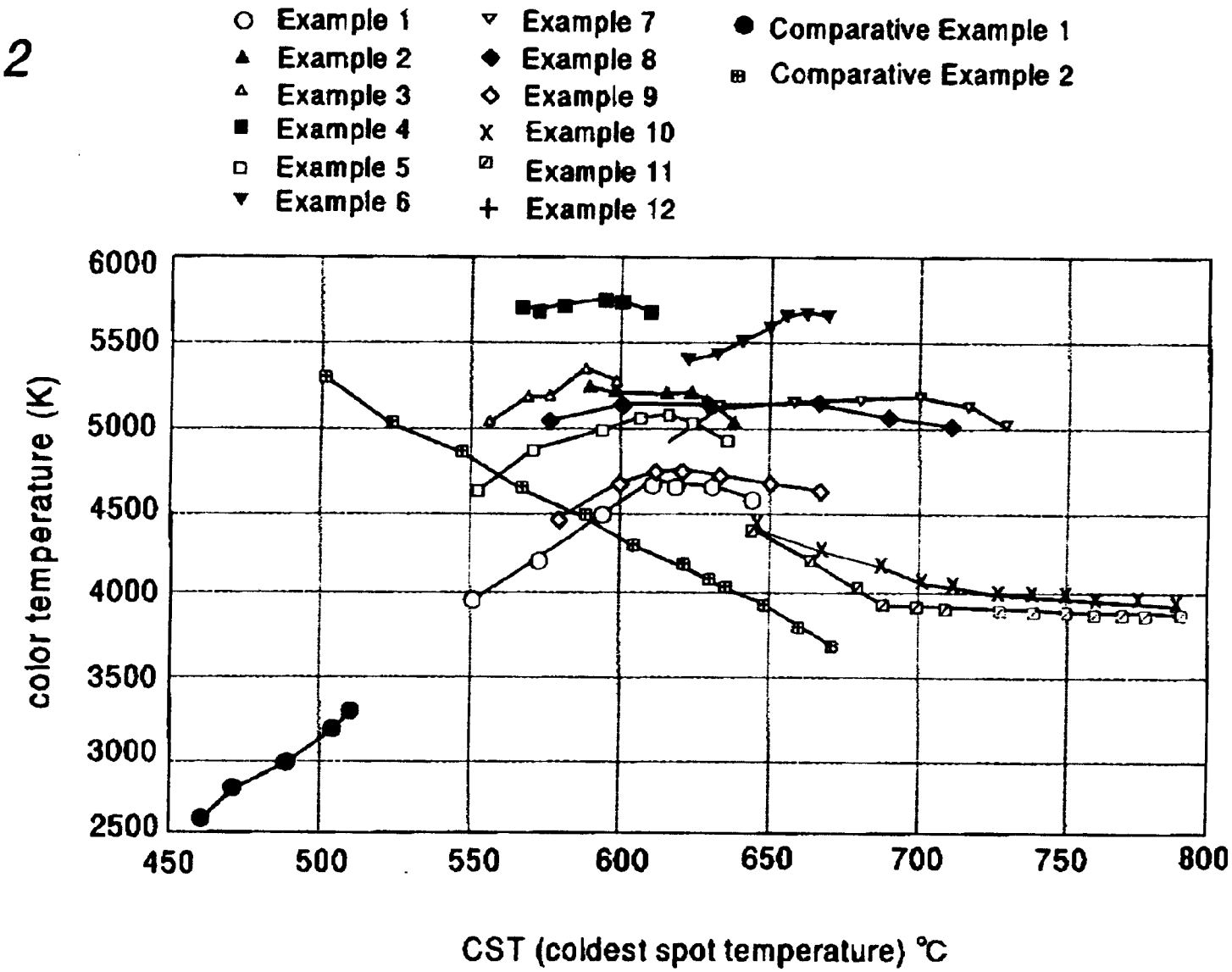
FIG. 12 is a graph showing characteristics of the lamp in accordance with examples 1 to 11.

FIG. 12 show curves plotting the coldest color temperatures (CST) changing with varying the lamp power for Examples 1 to 12, and Comparative Examples 1 and 2. The right end plot and the second one from the right of each curve was obtained when operating the lamp at 110%, and 100% of the rated power, respectively, while left and plots of curves for Examples 1 to 11 and Comparative Example 2 were obtained when operating the lamp at 50% of the rated lamp power. The curve for Comparative Example 1 has the left end plot which was obtained when operating the lamp at 63% of the rated lamp power.

EXAMPLES 12 to 17

Lamps were fabricated in accordance with the first embodiment to have arc tubes of quartz which were dimensioned to have an inside diameter of 8 mm, and a distance of 80 mm between the electrodes. The arc tubes were filled with sodium iodide and scandium iodide at varying molar ratio therebetween as listed in Table 2 below. Also, about 27000 Pa of xenon and $1.25\times10^{-5}$ mol/ml of cesium iodide were filled in the tube. For example lamp, the arc tube was contained in the evacuated envelope and is coated with the heat insulator layer of zirconium oxide. No sleeve was provided. Measurements were made to obtain the coldest spot temperature (CST) of each arc tube when operating the lamp at 100% and 50% of rated lamp power, respectively, and to obtain a width of color temperature change ΔT in response to ±10% variation in the source voltage.

TABLE 2

| Lamp | NaI/ $ScI_3$ (molar ratio) | WIa (%) | CST (° C.) | ΔT (K) on source voltage variation |
|---|---|---|---|---|
| Example 12 | 17.0 | 100 | 655 | 59 |
| | | 50 | 551 | |
| Example 13 | 14.2 | 100 | 645 | 47 |
| | | 54 | 853 | |
| Example 14 | 11.4 | 100 | 646 | 12 |
| | | 51 | 558 | |
| Example 15 | 8.5 | 100 | 669 | 45 |
| | | 50 | 579 | |
| Example 16 | 5.7 | 100 | 618 | 66 |
| | | 50 | 567 | |
| Example 17 | 2.8 | 100 | 638 | 44 |
| | | 55 | 589 | |

Figure 13:
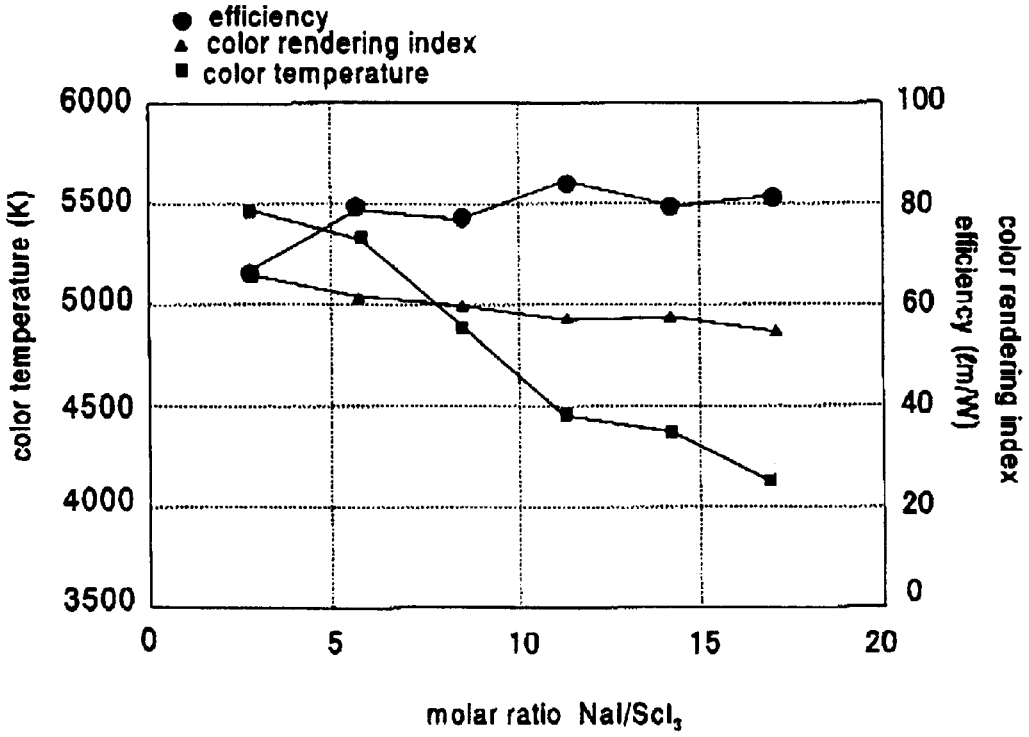
FIG. 13 is a graph showing characteristics of the lamp in accordance with examples 12 to 17.

It is confirmed from Table 2 that the color temperature change (ΔT) can be reduced while the molar ratio of sodium iodide to scandium iodide varies from 2.8 to 17.0. FIG. 13 show luminous efficiency, color rendering index, and color temperature measured for Examples 12 to 17. As seen form FIG. 13, it is known that Examples 12 to 17 show almost constant color rendering index of around 60, and efficiency of around 80 (lm/W), while showing varying color temperature as the molar ratio of sodium iodide to scandium iodide varies. With this result, it is found that a desired color can be chosen, yet reducing the color temperature variation ΔT against the variation in the source voltage.

EXAMPLES 18 to 21

Lamps were fabricated in accordance with the second embodiment to have arc tubes of quartz which were dimensioned to have a maximum inside diameter of 18 mm, an average inside diameter of 14 mm, and a distance of 48 mm between the electrodes. The arc tubes were filled with sodium iodide and scandium iodide at varying molar ratio therebetween as listed in Table 3 below. Also, about 6700 Pa of argon and $1.53\times10^{-5}$ mol/ml of mercury were filled in the tube. For each lamp, the arc tube was contained in the evacuated envelope and is coated with the heat insulator layer of zirconium oxide. No sleeve was provided. Measurements were made to obtain the coldest spot temperature (CST) of each arc tube when operating the lamp at 100% and 50% of rated lamp power, respectively, and to obtain a width of color temperature change ΔT in response to ±10% variation in the source voltage.

TABLE 3

| Lamp | NaI/$ScI_3$ (molar ratio) | WIa (%) | CST (° C.) | ΔT (K) on source voltage variation |
|---|---|---|---|---|
| Example 18 | 5.7 | 100 | 645 | 60 |
| | | 50 | 560 | |
| Example 19 | 11.4 | 100 | 752 | 85 |
| | | 50 | 645 | |
| Example 20 | 17.0 | 100 | 697 | 64 |
| | | 50 | 812 | |
| Example 21 | 22.7 | 100 | 759 | 79 |
| | | 50 | 609 | |

It is also confirmed from Table 3 that the color temperature change (ΔT) can be reduced while the molar ratio of sodium iodide to scandium iodide varies from 5.7 to 22.7.

EXAMPLE 22

Lamps were fabricated in accordance with the first embodiment to have arc tubes of quartz which were dimensioned to have an inside diameter of 8 mm, and a distance of 80 mm between the electrodes. The arc tubes were filled with scandium iodide at a varying mount between $1.02\times10^{-8}$ mol/ml and $4.59\times10^{-8}$ mol/ml and with sodium iodide at a varying molar ratio relative to scandium iodide from 0.0 to 19.8, as listed in Table 4 below. Also, about 27000 Pa of xenon was filled in the tube. For each lamp, the arc tube was contained in the evacuated envelope and was coated with the heat insulator layer of zirconium oxide to give the coldest spot temperature of 550° C. or more when operating the lamp at 50% of its rated lamp power. No sleeve was provided. Three samples were prepared for each lamp. Observation was made to see whether an arc bent occurred or not for three samples of identical lamp configuration. The results are shown in Table 4 in which mark '○' denotes no arc bent occurred in any of the three samples, mark 'Δ' denotes arc bent occurred in only one or two of the three samples, and mark 'X' denotes arc bent occurred in all of the three samples.

TABLE 4

| $ScI_3$ ($\times10^{-6}$ mol/ml) | NaI/$ScI_3$ (molar ratio) 19.8 | 17.0 | 14.2 | 11.4 | 8.5 | 5.7 | 2.8 | 0.0 |
|---|---|---|---|---|---|---|---|---|
| 4.59 | X | X | X | X | X | X | X | X |
| 4.08 | Δ | Δ | Δ | Δ | X | X | X | X |
| 3.57 | ○ | ○ | ○ | ○ | ○ | ○ | ○ | Δ |
| 3.06 | ○ | ○ | ○ | ○ | ○ | ○ | ○ | Δ |
| 2.55 | ○ | ○ | ○ | ○ | ○ | ○ | ○ | ○ |
| 2.04 | ○ | ○ | ○ | ○ | ○ | ○ | ○ | ○ |
| 1.02 | ○ | ○ | ○ | ○ | ○ | ○ | ○ | ○ |

Also, measurements were made to obtain a width of color temperature change ΔT in response to ±10% variation in the source voltage. The condition range encircled by double-lines in Table 4 are found effective to reduce the color temperature change ΔT. Thus, it is known that the color temperature change in kept at a reduced level even when the arc bent occurs. Taking this into consideration, it is found possible to stabilize the arc and at the same time to reduce the color temperature change by suitably selecting the filling amount of the scandium iodide and the molar ratio of the sodium iodide to scandium iodide.

EXAMPLE 23

Lamps were fabricated in accordance with the second embodiment to have arc tubes of quartz which were dimensioned to have a maximum inside diameter of 18 mm, an average inside diameter of 14 mm, and a distance of 48 mm between the electrodes. In order to further investigate the relation between the arc bent and the filling amount of scandium iodide, the arc tubes were filled with scandium iodide at a varying mount between $1.15\times10^{-8}$ mol/ml and $5.73\times10^{-6}$ mol/ml and with sodium iodide at a varying molar ratio relative to scandium iodide from 0.0 to 28.4, as listed in Table 5 below. Also, the arc tube was filled with about $2.15\times10^{-6}$ mol/ml of mercury and about 6700 Pa of argon was filled in the tube. For example lamp, the arc tube was contained in the evacuated envelope and was coated with the heat insulator layer of zirconium oxide to give the coldest spot temperature of 550° C. or more when operating the lamp at 50% of its rated lamp power. No sleeve was provided. Three samples were prepared for each lamp. Observation was made to see whether an arc bent occurred or not for three samples of identical lamp configuration. The results are shown in Table 5 in which the same marks as in Table 4 are utilized for evaluation of the occurrence of the arc bent.

TABLE 5

| $ScI_3$ | $NaI/ScI_3$ (molar ratio) | | | | | |
|---|---|---|---|---|---|---|
| ($\times10^{-8}$ mol/ml) | 28.4 | 22.7 | 17.0 | 11.4 | 5.7 | 0.0 |
| 5.73 | X | X | X | X | X | X |
| 4.61 | X | X | X | X | X | X |
| 4.08 | Δ | Δ | Δ | ○ | Δ | X |
| 3.45 | ○ | ○ | ○ | ○ | ○ | ○ |
| 2.31 | ○ | ○ | ○ | ○ | ○ | ○ |
| 1.15 | ○ | ○ | ○ | ○ | ○ | ○ |

Also, measurements were made to obtain a width of color temperature change ΔT in response to ±10% variation in the source voltage. The condition range encircled by double-lines in Table 5 are found effective to reduce the color temperature change ΔT. Thus, it is known that the color temperature change is kept at a reduced level even when the arc bent occurs. Taking this into consideration, it is found possible to stabilize the arc and at the same time to reduce the color temperature change by suitably selecting the filling amount of the scandium iodide and the molar ratio of the sodium iodide to scandium iodide.

EXAMPLE 24

A lamp was fabricated in accordance with the first embodiment to have the arc tube of quartz which was dimensioned to have an inside diameter of 8 mm, and a distance of 80 mm between the electrodes. The arc tube was filled with $2.32\times10^{-8}$ mol/ml of sodium iodide, $2.04\times10^{-8}$ mol/ml of scandium iodide (molar ratio of sodium iodide to scandium iodide is about 11.4), $1.02\times10^{-5}$ mol/ml of cesium iodide, and about 27000 Pa of xenon. The arc tube was contained in the evacuated envelope and was coated with the heat insulator layer of zirconium oxide to give the coldest spot temperature of 586° C. when operating the lamp at 50% of its rated lamp power. No sleeve was provided.

EXAMPLE 25

A lamp was fabricated in accordance with the first embodiment to have the arc tube of quartz which was dimensioned to have an inside diameter of 8 mm, and a distance of 80 mm between the electrodes. The arc tube was filled with $2.32\times10^{-5}$ mol/ml of sodium iodide, $2.04\times10^{-8}$ mol/ml of scandium iodide (molar ratio of sodium iodide to scandium iodide is about 11.4), $2.50\times10^{-5}$ mol/ml of mercury, and about 6700 Pa of argon. The arc tube was contained in the evacuated envelope and was coated with the heat insulator layer of zirconium oxide to give the coldest spot temperature of 569° C. when operating the lamp at 50% of its rated lamp power. No sleeve was provided, and the envelope was coated with a phosphor.

EXAMPLE 26

A lamp was fabricated in accordance with the second embodiment to have the arc tube of quartz which was dimensioned to have a maximum inside diameter of 18 mm, an average inside diameter of 14 mm and a distance of 48 mm between the electrodes. The arc tube was filled with $1.35\times10^{-5}$ mol/ml of sodium iodide, $1.15\times10^{-6}$ mol/ml of scandium iodide, $2.14\times10^{-5}$ mol/ml of mercury, and about 6700 Pa of argon. The arc tube was contained in the evacuated envelope and was coated with the heat insulator layer of zirconium oxide to give the coldest spot temperature of 552° C. when operating the lamp at 50% of its rated lamp power. No sleeve was provided.

EXAMPLE 27

A lamp was fabricated in accordance with the second embodiment to have the arc tube of quartz which was dimensioned to have a maximum inside diameter of 18 mm, an average inside diameter of 14 mm and a distance of 48 mm between the electrodes. The arc tube was filled with $1.35\times10^{-5}$ mol/ml of sodium iodide, $1.15\times10^{-6}$ mol/ml of scandium iodide, $1.53\times10^{-5}$ mol/ml of mercury, and about 6700 Pa of argon. The arc tube was contained in the envelope filled with about 47000 Pa of nitrogen and was coated with the heat insulator layer of zirconium oxide to give the coldest spot temperature of 551° C. when operating the lamp at 50% of its rated lamp power. No sleeve was provided.

For the lamps of Examples 24 to 27, measurements were made to obtain a width of color temperature change ΔT in response to ±10% variation in the source voltage. The results are shown in Table 6 below.

TABLE 6

| Lamp | WIa (%) | ΔT on ± 10% source voltage variation | CST (° C.) |
|---|---|---|---|
| Example 24 | 100 | 22 | 692 |
| | 50 | | 586 |
| Example 25 | 100 | 12 | 642 |
| | 50 | | 569 |
| Example 26 | 100 | 128 | 612 |
| | 50 | | 552 |
| Example 27 | 100 | 105 | 638 |
| | 50 | | 551 |

As seen in Table 6, the lamps of Examples 24 to 27 are found to show only reduced color temperature change ΔT. Particularly, the lamp of Examples 24 and 25 show a remarkably reduced color temperature change.

EXAMPLE 28

A lamp was fabricated in accordance with the first embodiment to have the arc tube of quartz which was dimensioned to have an inside diameter of 8 mm, and a distance of 80 mm between the electrodes. The arc tube was filled with $2.32\times10^{-5}$ mol/ml of sodium iodide, $2.04\times10^{-6}$ mol/ml of scandium iodide (molar radio of sodium iodide to scandium iodide is about 11.4), $1.20\times10^{-5}$ mol/ml of cesium iodide, and about 27000 Pa of xenon. The arc tube was contained in the evacuated envelope and was coated with the heat insulator layer of zirconium oxide to give the coldest spot temperature of 550° C. or more when operating the lamp of 50% of its rated lamp power. No sleeve was provided.

EXAMPLE 29

A lamp was fabricated in accordance with the first embodiment to have the arc tube of quartz which was dimensioned to have an inside diameter of 8 mm, and a distance of 80 mm between the electrodes. The arc tube was filled with $2.32\times10^{-5}$ mol/ml of sodium iodide, $2.04\times10^{-6}$ mol/ml of scandium iodide (molar ratio of sodium iodide to scandium iodide is about 11.4), $2.50\times10^{-5}$ mol/ml of mercury, and about 6700 Pa of argon. The arc tube was contained in the evacuated envelope and was coated with the heat insulator layer of zirconium oxide to give the coldest spot temperature of 550° C. or more when operating the lamp at 50% of its rated lamp power. No sleeve was provided.

EXAMPLE 30

A lamp was fabricated in accordance with the first embodiment to have the arc tube of quartz which was dimensioned to have an inside diameter of 8 mm, and a distance of 80 mm between the electrodes. The arc tube was filled with $2.32\times10^{-5}$ mol/ml of sodium iodide, $2.04\times10^{-8}$ mol/ml of scandium iodide (molar ratio of sodium iodide to scandium iodide is about 11.4), and about 27000 Pa of xenon. The arc tube was contained in the evacuated envelope and was coated with the heat insulator layer of zirconium oxide to give the coldest spot temperature of 550° C. or more when operating the lamp at 50% of its rated lamp power. No sleeve was provided.

For the lamps of Examples 28 to 30, measurements were made to obtain luminous flux (lm), luminous efficiency (lm/W), color temperature (Tc (K)), cooler temperature change (ΔT), cooler rendering index (Ra), coldest spot temperature (CST). The results are shown in Table 7 below, in which source voltage ratio (%) is a ratio of the source voltage relative to the voltage for operating the lamp at 100% of the rated lamp power, and the luminous flux ratio (%) is a ratio of the luminous flux to that obtained at 100% rated lamp power. The color temperature change (ΔT) denotes a value relative to the color temperature obtained at 100% rated lamp power.

As seen from Table 7, the lamps of Examples 28 to 30 exhibit reduced color temperature change (ΔT) against the varying lamp power as well as against the varying source voltage. The lamp of Example 28 in which the arc tube additionally contain cesium iodide has a superior effect of reducing the color temperature change as compared to the lamp of Example 30 in which no cesium iodide is contained in the arc tube. From this, it is found that the addition of cesium iodide is responsible for providing a wide range in which the color temperature change is kept reduced, advantageous for dimming the lamp without causing no substantial color change. Also, it is noted that the lamp of Example 29 exhibits the reduced color temperature change against varying lamp power, irrespective of the fact that the arc tube additionally contain mercury. Further, it is confirmed that when the envelope of Example 29 is coated with the phosphor as is made in Example 25, the color temperature change against the varying lamp power can be still reduced.

TABLE 7

| Lamp | Lamp power ratio (%) | Source voltage Vs (V) | Source voltage ratio (%) | Luminous flux (lm) | Luminous flux ratio (%) | Luminous Efficiency (lm/W) | Color temperature Tc (K) | Color temperature change ΔT | Color rendering Index <Ra> | coldest spot temperature CST (° C.) |
|---|---|---|---|---|---|---|---|---|---|---|
| Example 28 | 100 | 510 | 100 | 25102 | 100 | 84 | 3998 | 0 | 55 | 636 |
| | 92 | 475 | 93 | 22774 | 91 | 83 | 4081 | 83 | 55 | 624 |
| | 84 | 440 | 86 | 19630 | 78 | 78 | 4115 | 117 | 55 | 615 |
| | 75 | 405 | 79 | 16352 | 65 | 73 | 4143 | 145 | 56 | 605 |
| | 67 | 370 | 73 | 13183 | 53 | 66 | 4165 | 167 | 56 | 594 |
| | 59 | 320 | 63 | 10141 | 40 | 58 | 4139 | 141 | 56 | 570 |
| | 50 | 262 | 51 | 7160 | 29 | 47 | 4145 | 147 | 57 | 561 |
| | 41 | 201 | 39 | 4652 | 19 | 37 | 4192 | 194 | 59 | 553 |
| Example 29 | 100 | 440 | 100 | 23610 | 100 | 79 | 5204 | 0 | 62 | 618 |
| | 92 | 412 | 94 | 20140 | 85 | 73 | 5275 | 71 | 59 | 801 |
| | 84 | 386 | 88 | 18651 | 71 | 66 | 5238 | 134 | 56 | 595 |
| | 75 | 367 | 83 | 13301 | 56 | 59 | 5207 | 3 | 54 | 588 |
| | 67 | 340 | 77 | 10177 | 43 | 51 | 5167 | −37 | 45 | 579 |
| | 58 | 328 | 75 | 6748 | 29 | 39 | 5055 | −149 | 48 | 564 |
| | 50 | 312 | 71 | 3210 | 14 | 21 | 4998 | −206 | 50 | 551 |
| | 42 | 305 | 69 | 1695 | 7 | 14 | 4980 | −224 | 51 | 525 |
| Example 30 | 100 | 590 | 100 | 23052 | 100 | 77 | 4557 | 0 | 59 | 644 |
| | 92 | 550 | 93 | 19143 | 83 | 70 | 4628 | 71 | 60 | 631 |
| | 83 | 512 | 87 | 16235 | 70 | 65 | 4643 | 86 | 60 | 618 |
| | 75 | 460 | 78 | 13395 | 58 | 60 | 4657 | 100 | 60 | 610 |
| | 67 | 410 | 69 | 10023 | 43 | 50 | 4477 | −80 | 61 | 594 |
| | 58 | 359 | 61 | 7596 | 33 | 43 | 4201 | −356 | 61 | 572 |
| | 50 | 292 | 49 | 3443 | 15 | 23 | 3952 | −605 | 63 | 551 |
| | 41 | 215 | 36 | 1125 | 5 | 9 | 3562 | −995 | 65 | 512 |

EXAMPLE 31

A lamp was fabricated in accordance with the second embodiment to have the arc tube of quartz which was dimensioned to have a maximum inside diameter of 18 mm, an average inside diameter of 14 mm, and a distance of 48 mm between the electrodes. The arc tube was filled with $1.35\times10^{-5}$ mol/ml of sodium iodide, $1.5\times10^{-6}$ mol/ml of scandium iodide, $2.14\times10^{-5}$ mol/ml of mercury, and about 6700 Pa of argon. The arc tube was contained in the evacuated envelope and was coated with the heat insulator layer of zirconium oxide to give the coldest spot temperature of 550° C. or more when operating the lamp at 50% of its rated lamp power. No sleeve was provided.

EXAMPLE 32

A lamp was fabricated in accordance with the second embodiment to have the arc tube of quartz which was dimensioned to have a maximum inside diameter of 18 mm, an average inside diameter of 14 mm, and a distance of 48 mm between the electrodes. The arc tube was filled with $1.35\times10^{-5}$ mol/ml of sodium iodide, $1.15\times10^{-6}$ mol/ml of scandium iodide, $1.53\times10^{-5}$ mol/ml of mercury, and about 6700 Pa of argon. The arc tube was contained in the envelope filled with about 47000 Pa of nitrogen, and was coated with the heat insulator layer of zirconium oxide to give the coldest spot temperature of 550° C. or more when operating the lamp at 50% of its rated lamp power. No sleeve was provided, and the envelope was coated with the phosphor. The lamp of Example 32 differs from the lamp of Example 31 only in that the envelope was filled with nitrogen and was coated with the phosphor.

EXAMPLE 33

A lamp was fabricated in accordance with the second embodiment to have the arc tube of quartz which was dimensioned to have a maximum inside diameter of 18 mm, an average inside diameter of 14 mm, and a distance of 48 mm between the electrodes. The arc tube was filled with $1.35\times10^{-5}$ mol/ml of sodium iodide, $1.15\times10^{-6}$ mol/ml of scandium iodide, $2.14\times10^{-5}$ mol/ml of mercury, and about 6700 Pa of argon. The arc tube was contained in the envelope filled with about 47000 Pa of nitrogen, and was coated with the heat insulator layer of zirconium oxide to give the coldest spot temperature of 550° C. or more than operating the lamp at 50% of its rated lamp power. No sleeve was provided. The lamp of Example 33 differs from the lamp of Example 31 only in the provision of nitrogen filled in the envelope.

For the lamps of Examples 31 to 33, like measurements as made for Examples 28 to 30 were done. The results are shown in Table 8 below in which the source voltage ratio (%) for Example 31 and 32 denotes a ratio of the source voltage relative to 200 V, the source voltage ratio (%) for Example 33 denotes a ratio of the source voltage relative to the voltage for operating the lamp at 100% of the rated lamp power, and the luminous flux ratio (%) is a ratio of the luminous flux to that obtained at 100 V source voltage.

Considering the results of Example 31 in which the envelope is not coated with the phosphor and the results of Example 32 in which the envelope is coated with the phosphor (emitting red light), both Examples show reduced color temperature change responsible for superior dimming characteristics although the phosphor coating can slightly lower the color temperature. Comparing the results of Example 31 having the evacuated envelope with the results of Example 33 having the envelope filled with nitrogen gas, it is confirmed that the lamp of Example 33 is also effective to reduce the color temperature change and is advantageous for making the dimmer control without causing substantial change in color.

Figure 15:
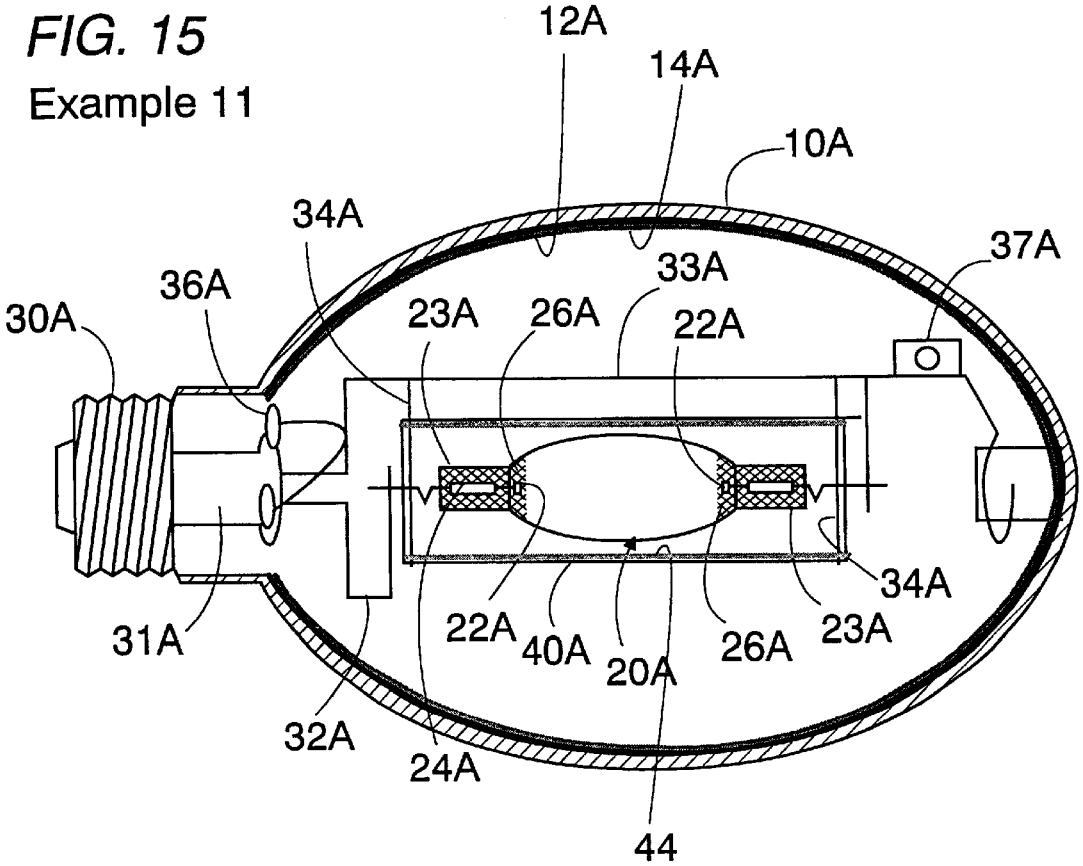
FIG. 15 is a cross section of the metal halide discharge lamp similar to the one shown in FIG. 8 with a phosphor layer and an infrared radiation reflecting layer.
Figure 16:
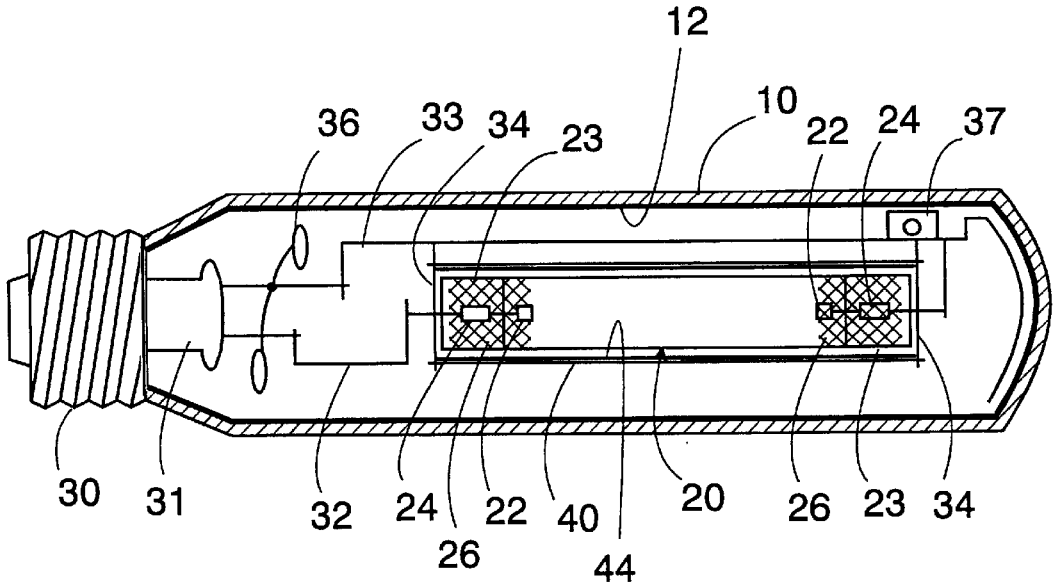
FIG. 16 is a cross section of the metal halide discharge lamp similar to the one shown in FIG. 1 with a phosphor layer and an infrared radiation reflecting layer applied to an arc tube.
Figure 17:
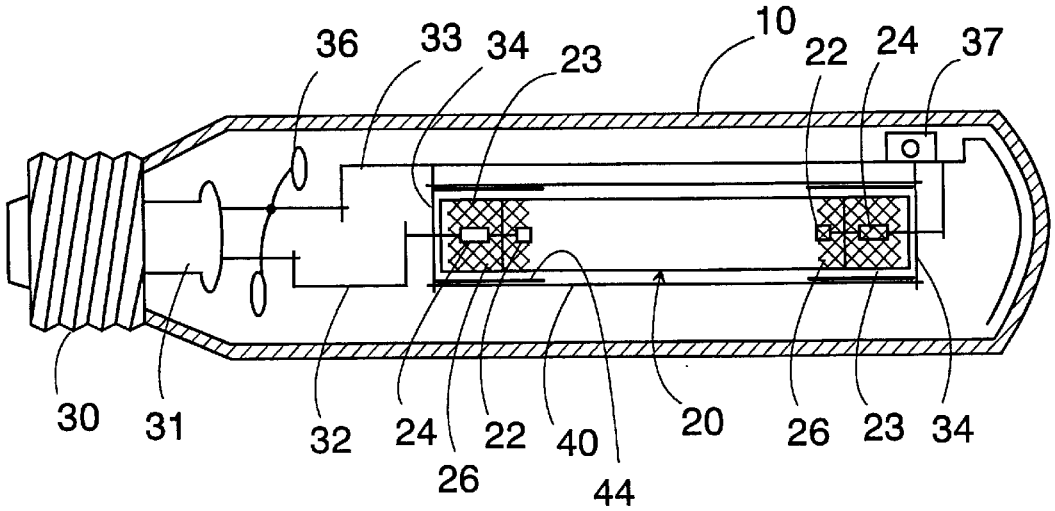
FIG. 17 is a cross section of the metal halide discharge lamp similar to the one shown in FIG. 1 with an infrared radiation reflecting layer applied to the arc tube.

As illustrated in FIGS. 14 and 15, the envelope has its inner surface coated with an infrared radiation reflecting layer 14 and 14A respectively. As illustrated by way of example in FIG. 14, the arc tube is filled with mercury M as the filler F. As shown in FIGS. 15 and 16, the envelope has its inner surface coated with a phosphor layer 12A and 12 respectively. As shown in FIG. 17, the sleeve 40 has its inner surface coated with an infrared radiation reflecting layer 44.

Although in the above Examples, metal iodides are utilized as metal halides, the present invention is not limited to the metal iodides and should be equally applicable to metal bromides. Also, either when the lamp is operated at a horizontal position where the electrodes are spaced horizontally or at a vertical position where the electrodes are spaced vertically, the like results were obtained as demonstrated in the above Examples. Further, the like results were obtained to the lamps with the arc tubes having dimensions different from Examples and having rate gases of different filling pressures.

TABLE 8

| Lamp | Lamp power ratio (%) | Source voltage Vs (V) | Source voltage ratio (%) | Luminous flux (lm) | Luminous flux ratio (%) | Luminous Efficiency (lm/W) | Color temperature Tc (K) | Color temperature change ΔT | Color rendering Index <Ra> | coldest spot temperature CST (° C.) |
|---|---|---|---|---|---|---|---|---|---|---|
| Example 31 | 125 | 240 | 120 | 58190 | 140 | 116 | 3898 | 0 | 72 | 805 |
| | 119 | 232 | 116 | 53740 | 133 | 113 | 3900 | 2 | 71 | 800 |
| | 112 | 225 | 112 | 50584 | 125 | 113 | 3932 | 34 | 71 | 788 |
| | 106 | 218 | 109 | 47624 | 118 | 112 | 3951 | 53 | 70 | 778 |
| | 100 | 210 | 105 | 44648 | 111 | 112 | 3961 | 63 | 70 | 765 |
| | 93 | 202 | 101 | 41564 | 103 | 111 | 3973 | 75 | 69 | 760 |
| | 91 | 200 | 100 | 40406 | 100 | 110 | 3978 | 80 | 69 | 752 |
| | 88 | 195 | 96 | 38462 | 95 | 110 | 3984 | 86 | 68 | 741 |
| | 81 | 187 | 94 | 35197 | 87 | 108 | 3995 | 97 | 67 | 728 |
| | 75 | 179 | 90 | 31998 | 79 | 107 | 4017 | 119 | 66 | 714 |
| | 69 | 172 | 86 | 28664 | 71 | 104 | 4052 | 154 | 65 | 703 |
| | 63 | 165 | 83 | 25391 | 63 | 101 | 4123 | 225 | 63 | 689 |
| | 57 | 158 | 79 | 21823 | 54 | 97 | 4222 | 324 | 62 | 668 |
| | 50 | 152 | 76 | 18213 | 45 | 91 | 4377 | 479 | 61 | 645 |
| Example 32 | 125 | 241 | 121 | 50500 | 140 | 101 | 3880 | 0 | 73 | 791 |
| | 118 | 233 | 117 | 48181 | 134 | 102 | 3895 | 15 | 72 | 779 |
| | 113 | 226 | 113 | 45801 | 127 | 102 | 3900 | 20 | 72 | 770 |
| | 106 | 218 | 109 | 42894 | 119 | 101 | 3907 | 27 | 71 | 760 |
| | 100 | 211 | 106 | 40107 | 111 | 100 | 3913 | 33 | 71 | 751 |

TABLE 8-continued

| Lamp | Lamp power ratio (%) | Source voltage Vs (V) | Source voltage ratio (%) | Luminous flux (lm) | Luminous flux ratio (%) | Luminous Efficiency (lm/W) | Color temperature Tc (K) | Color temperature change ΔT | Color rendering Index <Ra> | coldest spot temperature CST (° C.) |
|---|---|---|---|---|---|---|---|---|---|---|
| | 94 | 203 | 102 | 37350 | 104 | 100 | 3920 | 40 | 70 | 740 |
| | 91 | 200 | 100 | 36072 | 100 | 99 | 3923 | 43 | 70 | 728 |
| | 87 | 195 | 98 | 34415 | 95 | 98 | 3927 | 47 | 70 | 728 |
| | 81 | 188 | 94 | 31900 | 88 | 98 | 3931 | 51 | 69 | 710 |
| | 75 | 180 | 90 | 28816 | 80 | 98 | 3934 | 54 | 68 | 700 |
| | 69 | 173 | 86 | 26019 | 72 | 94 | 3937 | 57 | 67 | 689 |
| | 63 | 165 | 83 | 22921 | 64 | 91 | 4035 | 155 | 66 | 680 |
| | 56 | 158 | 79 | 19605 | 54 | 87 | 4181 | 301 | 65 | 665 |
| | 50 | 153 | 77 | 16070 | 45 | 80 | 4367 | 487 | 65 | 650 |
| Example 33 | 125 | 238 | 114 | 55500 | 131 | 111 | 4095 | 0 | 71 | 698 |
| | 119 | 232 | 111 | 52250 | 123 | 110 | 4100 | 5 | 71 | 689 |
| | 112 | 224 | 107 | 48287 | 114 | 108 | 4108 | 13 | 70 | 678 |
| | 106 | 217 | 104 | 45476 | 107 | 107 | 4107 | 12 | 69 | 667 |
| | 100 | 209 | 100 | 42386 | 100 | 106 | 4106 | 11 | 68 | 652 |
| | 94 | 202 | 96 | 39239 | 93 | 104 | 4110 | 15 | 67 | 645 |
| | 92 | 200 | 95 | 38415 | 91 | 104 | 4115 | 20 | 67 | 638 |
| | 88 | 194 | 93 | 36055 | 85 | 103 | 4134 | 39 | 66 | 629 |
| | 81 | 186 | 89 | 32630 | 77 | 100 | 4161 | 66 | 65 | 619 |
| | 75 | 179 | 85 | 29064 | 69 | 97 | 4231 | 118 | 64 | 611 |
| | 69 | 171 | 82 | 25712 | 61 | 93 | 4311 | 216 | 62 | 601 |
| | 63 | 164 | 78 | 22211 | 52 | 88 | 4439 | 344 | 61 | 592 |
| | 56 | 158 | 75 | 18249 | 43 | 81 | 4627 | 532 | 57 | 580 |
| | 50 | 153 | 73 | 14710 | 35 | 73 | 4707 | 612 | 53 | 568 |
| | 44 | 148 | 71 | 11032 | 26 | 63 | 4785 | 690 | 44 | 551 |

What is claimed is:

1. A metal halide discharge lamp comprising:

an arc tube filled with at least sodium halide and scandium halide, said arc tube being formed at its opposite ends with electrodes which gives an arc therebetween; and a regulator for keeping a coldest spot temperature of said arc tube at 550° C. or more when operating the lamp at a lamp power which is 50% of rated lamp power of said lamp, wherein a molar ratio (R) of said sodium halide and said scandium halide filled in said arc tube satisfies a relation that $2.8 \leqq R \leqq 22.7$.

2. The metal halide discharge lamp as set fort in claim 1, wherein said lamp has a rated lamp power less than 400 W, and a molar ratio (R) of said sodium halide and said scandium halide filled in said arc tube satisfies a relation that $2.8 \leqq R \leqq 17.0$.

3. The metal halide discharge lamp as set fort in claim 1, wherein said lamp has a rated lamp power is 400 W or more, and a molar ratio (R) of said sodium halide and said scandium halide filled in said arc tube satisfies a relation that $5.7 \leqq R \leqq 22.7$.

4. The metal halide discharge lamp as set forth in claim 1, wherein said regulator comprises an envelope which forms a hermetically sealed space within which said arc tube is disposed.

5. The metal halide discharge lamp as set fort in claim 1, wherein said lamp has a rated lamp power of less than 400 W, and said regulator comprises an envelope which forms a hermetically sealed space within which said arc tube is disposed, said space being evacuated.

6. The metal halide discharge lamp as set forth in claim 1, wherein said lamp has a rated power of 400 W or more, and said regulator comprises an envelope which forms a hermetically sealed space within which said arc tube is disposed, said space being evacuated or filled with a low pressure inert gas.

7. The metal halide discharge lamp as set forth in claim 1, wherein said regulator comprises an infrared radiation reflecting layer coated on an inner surface of an envelope within which said arc tube is disposed.

8. The metal halide discharge lamp as set forth in claim 1, wherein said regulator comprises a transparent sleeve surrounding said arc tube within an envelope.

9. The metal halide discharge lamp as set fort in claim 8, wherein said sleeve has its inner surface coated with an infrared radiation reflecting layer.

10. The metal halide discharge lamp as set fort in claim 8, wherein said sleeve being coated with an infrared radiation reflecting layer at opposite ends of said sleeve corresponding to said electrodes.

11. The metal halide discharge lamp as set fort in claim 1, wherein said regulator comprises heat insulators covering electrodes at the opposite ends of said arc tube.

12. The metal halide discharge lamp as set fort in claim 11, wherein said heat insulator comprises a metal layer reflecting an infrared radiation.

13. The metal halide discharge lamp as set fort in claim 11, wherein said heat insulator comprises a metal layer reflecting an infrared radiation, said metal layer covering said electrodes at the opposite ends of said arc tube.

14. The metal halide discharge lamp as set fort in claim 1, wherein said regulator comprises reduced-in-diameter sections formed at the opposite ends of said arc tube, said reduced-in-diameter sections surrounding said electrodes, respectively.

15. The metal halide discharge lamp as set fort in claim 1, wherein said regulator comprises sealed ends formed at opposite ends of said arc tube for sealing said electrodes, said sealed ends having an outside diameter less than that of said arc tube at a portion other than said sealed ends.

16. The metal halide discharge lamp as set fort in claim 1, wherein said arc tube is made of a transparent ceramic.

17. The metal halide discharge lamp as set fort in claim 1, wherein said scandium halide is filled in an amount of less than $4.08\times10^{-6}$ mol/ml.

18. The metal halide discharge lamp as set fort in claim 1, wherein said arc tube is also filled with cesium halide.

19. A discharge lamp ballast for operating a metal halide discharge lamp, said lamp comprising:

an arc tube filled with at least sodium halide and scandium halide, said arc tube being formed at its opposite ends with electrodes which gives an arc therebetween; and regulator for keeping a coldest spot temperature of said arc tube at 550° C. or more when operating the lamp at a lamp power which is 50% of rated lamp power of said lamp, said lamp having a rated lamp power less than 400 W, and a molar ratio (R) of said sodium halide and said scandium halide filled in said arc tube satisfies a relation that $2.8\leqq R\leqq 17.0$, said ballast comprising a dimmer for varying a lamp power to be applied to the lamp from 100% to 50% of a rated lamp power.

20. A discharge lamp ballast for operating a metal halide discharge lamp, said lamp comprising:

an arc tube filled with at least sodium halide and scandium halide, said arc tube being formed at its opposite ends with electrodes which gives an arc therebetween; and regulator for keeping a coldest spot temperature of said arc tube at 550° C. or more when operating the lamp at a lamp power which is 50% of rated lamp power of said lamp, said lamp having a rated lamp power is 400 W or more, and a molar ratio (R) of said sodium halide and said scandium halide filled in said arc tube satisfies a relation that $5.7\leqq R\leqq 22.7$, said ballast comprising a dimmer for varying a lamp power to be applied to the lamp from 125% to 50% of a rated lamp power.

21. A metal halide discharge lamp, comprising:

an arc tube filled with at least sodium halide and scandium halide, said arc tube being formed at its opposite sealed ends with electrodes which gives an arc therebetween; and a regulator for keeping a coldest spot temperature of said arc tube at 550° C. or more when operating the lamp at a lamp power which is 50% of rated lamp power of said lamp, wherein a molar ratio R of said sodium halide and said scandium halide filled in said arc tube satisfies a relation that $2.8\leqq R\leqq 22.7$, said arc tube being formed at its opposite sealed ends respectively with foils, each connected to each of said electrodes, said regulator including heat insulation layers respectively over said sealed ends in such a manner as to surround said electrodes as well as said foils entirely with respect to an axial length of said arc tube, said heat insulation layer being a metal layer reflecting an infrared radiation, said regulator also including a transparent sleeve which surrounds substantially the full axial length of said arc tube, said transparent sleeve being coated on its opposite axial ends with an infrared radiation reflection layer.

* * * * *